US012454948B2

(12) United States Patent
Urata et al.

(10) Patent No.: US 12,454,948 B2
(45) Date of Patent: Oct. 28, 2025

(54) BELLOWS PUMP DEVICE

(71) Applicant: PILLAR CORPORATION, Osaka (JP)

(72) Inventors: Daisuke Urata, Osaka (JP); Katsuhiko Fukui, Osaka (JP)

(73) Assignee: PILLAR CORPORATION, Osaka (JP)

( * ) Notice: Subject to any disclaimer, the term of this patent is extended or adjusted under 35 U.S.C. 154(b) by 0 days.

(21) Appl. No.: 18/854,054

(22) PCT Filed: Jan. 13, 2023

(86) PCT No.: PCT/JP2023/000830
§ 371 (c)(1),
(2) Date: Oct. 3, 2024

(87) PCT Pub. No.: WO2023/223603
PCT Pub. Date: Nov. 23, 2023

(65) Prior Publication Data

US 2025/0223955 A1 Jul. 10, 2025

(30) Foreign Application Priority Data

May 18, 2022 (JP) ..... 2022-081492

(51) Int. Cl.
*F04B 45/02* (2006.01)
*F04B 43/00* (2006.01)
(Continued)

(52) U.S. Cl.
CPC ..... *F04B 45/022* (2013.01); *F04B 43/0081* (2013.01); *F04B 43/1136* (2013.01); *F04B 49/08* (2013.01)

(58) Field of Classification Search
CPC .. F04B 43/1136; F04B 45/022; F04B 45/064; F04B 45/0736; F04B 49/08
See application file for complete search history.

(56) References Cited

U.S. PATENT DOCUMENTS 5,088,898 A * 2/1992 Fukumoto ..... F04B 11/005 417/343
5,641,270 A * 6/1997 Sgourakes ..... F04B 43/04 417/322
(Continued)

FOREIGN PATENT DOCUMENTS

JP 2004-293502 A 10/2004
JP 5315550 B2 * 10/2013 ..... F04B 43/113
(Continued)

OTHER PUBLICATIONS

International Search Report issued in corresponding International Application No. PCT/JP2023/000830, dated Mar. 28, 2023 (5 pages).

*Primary Examiner* — Jonathan R Matthias
(74) *Attorney, Agent, or Firm* — Osha Bergman Watanabe & Burton LLP

(57) ABSTRACT

A control unit of a bellows pump device performs pressure increase control of determining whether or not a second bellows (first bellows) is in the middle of expansion when the first bellows (second bellows) contracts to a mid-contraction state, and when a determination result thereof is positive, outputting a pressure increase command to a second electropneumatic regulator (first electropneumatic regulator) such that an air pressure of pressurized air to be supplied to a second suction-side air chamber (first suction-side air chamber) of a second driving unit (first driving unit) is increased at next expansion of the second bellows (first bellows). The control unit counts the number of times the pressure increase control has been consecutively performed, and when the counted number of times has exceeded a predetermined number of times, the control unit determines that the second electropneumatic regulator (first electropneumatic regulator) is abnormal.

5 Claims, 7 Drawing Sheets

(51) Int. Cl.
*F04B 43/113* (2006.01)
*F04B 49/08* (2006.01)

(56) References Cited

U.S. PATENT DOCUMENTS

| | | | | |
|---|---|---|---|---|
| 2004/0037722 | A1* | 2/2004 | Watanabe | F04B 43/084 417/473 |
| 2010/0119392 | A1* | 5/2010 | Masuda | F04B 43/084 417/472 |
| 2011/0318207 | A1* | 12/2011 | Katsura | F04B 43/086 417/472 |
| 2014/0010689 | A1* | 1/2014 | Iwabuchi | F04B 43/1136 417/472 |
| 2014/0072465 | A1* | 3/2014 | Adachi | F04B 45/022 417/472 |
| 2017/0191476 | A1* | 7/2017 | Matsuda | F04B 53/10 |
| 2017/0218946 | A1* | 8/2017 | Yamada | F04B 49/06 |
| 2017/0350382 | A1* | 12/2017 | Nakano | F04B 43/10 |

FOREIGN PATENT DOCUMENTS

| | | | |
|---|---|---|---|
| JP | 2017-219002 | A | 12/2017 |
| WO | 2016/021350 | A1 | 2/2016 |

* cited by examiner

BELLOWS PUMP DEVICE

TECHNICAL FIELD

The present invention relates to a bellows pump device.

BACKGROUND ART

For example, a bellows pump described in PATENT LITERATURE 1 has been known as a bellows pump used for feeding a transport fluid such as a chemical solution or a solvent in semiconductor production, chemical industries, or the like. The bellows pump described in PATENT LITERATURE 1 includes: a pair of bellows configured to suck a transport fluid thereinto and discharge the transport fluid therefrom by expanding/contracting independently of each other; and a pair of air cylinders configured to cause the respective bellows to expand/contract, by supplying/discharging pressurized air. This bellows pump controls drive of each air cylinder such that, before one bellows contracts most (ends the discharge), the other bellows is caused to contract from a most expanded state to discharge the transport fluid.

By controlling drive of each air cylinder as described above, at a time when one bellows switches from contraction to expansion (from discharge to suction of the transport fluid), the other bellows has already contracted to discharge the transport fluid. Accordingly, great fall of the discharge pressure of the transport fluid at the above time can be reduced, so that pulsation on the discharge side of the bellows pump can be reduced.

CITATION LIST

Patent Literature

PATENT LITERATURE 1: Japanese Laid-Open Patent Publication No. 2004-293502

SUMMARY OF THE INVENTION

Technical Problem

In the above bellows pump, before one bellows contracts most (ends the discharge), it is necessary to cause the other bellows to expand most (end the suction). However, when the atmospheric temperature, the flow rate of the transport fluid, or the like changes, the hardness of each bellows changes due to the influence thereof. When the hardness of each bellows changes, the expansion time (suction time) of the bellows may change, pulsation on the discharge side of the bellows pump may be deteriorated, and an impact pressure called "water hammer" may be generated or cavitation may occur, thereby adversely affecting the bellows pump.

Therefore, the applicant has proposed a bellows pump device that automatically resets the air pressure of pressurized air to be supplied to an air chamber of each air cylinder to an appropriate value using an electropneumatic regulator such that the expansion time of each bellows becomes an appropriate time (International Application No. PCT/JP2021/034699). In this bellows pump device, when one bellows contracts to a mid-contraction state, if the other bellows has not expanded to a predetermined expanded state, a control unit performs pressure increase control of increasing the air pressure of the pressurized air to be supplied to the air chamber of the air cylinder, at the next expansion of the other bellows. In addition, when the one bellows contracts to the mid-contraction state, if the other bellows has continued to be in the predetermined expanded state for a predetermined time or longer, the control unit performs pressure decrease control of decreasing the air pressure of the pressurized air to be supplied to the air chamber of the air cylinder, at the next expansion of the other bellows.

However, each electropneumatic regulator is generally configured such that, when an abnormality such as a failure occurs in the electropneumatic regulator, an air pressure adjusted immediately before the occurrence of the abnormality is maintained. Therefore, the pressurized air of the air pressure adjusted immediately before the occurrence of the abnormality is constantly supplied to the air cylinder, and the bellows continues to perform expansion/contraction operation with this pressurized air. As the expansion/contraction operation of the bellows continues as described above, the expansion time of the bellows may change, thereby adversely affecting the bellows pump as described above. As a countermeasure for this, it is conceivable to monitor the air pressure of the electropneumatic regulator. However, in this case, another line for monitoring the air pressure, a pressure gauge for detecting air pressure, etc., need to be newly connected to an output line of the electropneumatic regulator, which leads to an increase in cost.

The present disclosure has been made in view of such circumstances, and an object of the present disclosure is to provide a bellows pump device that can grasp that an abnormality has occurred in a fluid pressure adjustment unit, with an inexpensive configuration.

Solution to Problem (1) The present disclosure is directed to a bellows pump device including a pair of bellows expandable/contractible independently of each other and configured to suck a transport fluid thereinto by expansion thereof and to discharge the transport fluid therefrom by contraction thereof, a pair of driving units each having a suction-side fluid chamber and a discharge-side fluid chamber and configured to cause the respective bellows to expand to a predetermined expanded state by supplying a pressurized fluid to the suction-side fluid chambers and to cause the respective bellows to contract to a predetermined contracted state by supplying the pressurized fluid to the discharge-side fluid chambers, a pair of fluid pressure adjustment units configured to adjust fluid pressures of a pressurized fluid to be supplied to the suction-side fluid chambers of the respective driving units, a pair of detection units configured to detect expanded/contracted states of the respective bellows, and a control unit configured to control the pair of driving units and the pair of fluid pressure adjustment units on the basis of respective detection signals of the pair of detection units, wherein: the control unit performs drive control of controlling the pair of driving units such that, before one bellows out of the pair of bellows comes into the contracted state, the other bellows is caused to contract from the expanded state; the control unit performs pressure increase control of performing a pressure increase determination of determining whether or not the other bellows is in the middle of expansion when the one bellows contracts to a mid-contraction state before the contracted state, and when a determination result of the pressure increase determination is positive, outputting a pressure increase command to the fluid pressure adjustment unit corresponding to the driving unit for causing the other bellows to expand, such that the fluid pressure at next expansion of the other bellows is increased; and the control unit counts a number of times the pressure increase control has been consecutively performed, and when the counted number of times has exceeded a predetermined number of times, the control unit determines that the fluid pressure adjustment unit is abnormal.

In the bellows pump device of the present disclosure, when an abnormality occurs in the fluid pressure adjustment unit and the fluid pressure adjustment unit maintains the fluid pressure adjusted immediately before the occurrence of the abnormality, even if the control unit outputs the pressure increase command in the pressure increase control to the fluid pressure adjustment unit, the pressure of the fluid pressure cannot be increased by the fluid pressure adjustment unit. Therefore, the control unit consecutively outputs the pressure increase command to the fluid pressure adjustment unit. The inventors of the present application have completed the present disclosure by focusing on this point. That is, the control unit counts the number of times the pressure increase control has been consecutively performed, and when the counted number of times has exceeded the predetermined number of times, the control unit determines that the fluid pressure adjustment unit is abnormal. Accordingly, with an inexpensive configuration that does not use a pressure gauge or the like, it is possible to grasp that an abnormality has occurred in the fluid pressure adjustment unit.

(2) According to another aspect, the present disclosure is directed to a bellows pump device including a pair of bellows expandable/contractible independently of each other and configured to suck a transport fluid thereinto by expansion thereof and to discharge the transport fluid therefrom by contraction thereof, a pair of driving units each having a suction-side fluid chamber and a discharge-side fluid chamber and configured to cause the respective bellows to expand to a predetermined expanded state by supplying a pressurized fluid to the suction-side fluid chambers and to cause the respective bellows to contract to a predetermined contracted state by supplying the pressurized fluid to the discharge-side fluid chambers, a pair of fluid pressure adjustment units configured to adjust fluid pressures of a pressurized fluid to be supplied to the suction-side fluid chambers of the respective driving units, a pair of detection units configured to detect expanded/contracted states of the respective bellows, and a control unit configured to control the pair of driving units and the pair of fluid pressure adjustment units on the basis of respective detection signals of the pair of detection units, wherein: the control unit performs drive control of controlling the pair of driving units such that, before one bellows out of the pair of bellows comes into the contracted state, the other bellows is caused to contract from the expanded state; the control unit performs pressure decrease control of performing a pressure decrease determination of determining whether or not the other bellows has continued to be in the expanded state for a predetermined time or longer when the one bellows contracts to a mid-contraction state before the contracted state, and when a determination result of the pressure decrease determination is positive, outputting a pressure decrease command to the fluid pressure adjustment unit corresponding to the driving unit for causing the other bellows to expand, such that the fluid pressure at next expansion of the other bellows is decreased; and the control unit counts a number of times the pressure decrease control has been consecutively performed, and when the counted number of times has exceeded a predetermined number of times, the control unit determines that the fluid pressure adjustment unit is abnormal.

In the bellows pump device of the present disclosure, when an abnormality occurs in the fluid pressure adjustment unit and the fluid pressure adjustment unit maintains the fluid pressure adjusted immediately before the occurrence of the abnormality, even if the control unit outputs the pressure decrease command in the pressure decrease control to the fluid pressure adjustment unit, the pressure of the fluid pressure cannot be decreased by the fluid pressure adjustment unit. Therefore, the control unit consecutively outputs the pressure decrease command to the fluid pressure adjustment unit. The inventors of the present application have completed the present disclosure by focusing on this point. That is, the control unit counts the number of times the pressure decrease control has been consecutively performed, and when the counted number of times has exceeded the predetermined number of times, the control unit determines that the fluid pressure adjustment unit is abnormal. Accordingly, with an inexpensive configuration that does not use a pressure gauge or the like, it is possible to grasp that an abnormality has occurred in the fluid pressure adjustment unit.

(3) In the bellows pump device of (1) above, preferably, the control unit further performs pressure decrease control of performing a pressure decrease determination of determining whether or not the other bellows has continued to be in the expanded state for a predetermined time or longer when the one bellows contracts to the mid-contraction state before the contracted state, and when a determination result of the pressure decrease determination is positive, outputting a pressure decrease command to the fluid pressure adjustment unit corresponding to the driving unit for causing the other bellows to expand, such that the fluid pressure at next expansion of the other bellows is decreased; and the control unit counts a number of times the pressure decrease control has been consecutively performed, and when either one of the number of times the pressure increase control has been consecutively performed and the number of times the pressure decrease control has been consecutively performed has exceeded the predetermined number of times, the control unit determines that the fluid pressure adjustment unit is abnormal.

In this case, regardless of whether the pressure increase control is consecutively performed or the pressure decrease control is consecutively performed, it is possible to grasp that an abnormality has occurred in the fluid pressure adjustment unit.

(4) In the bellows pump device of (1) or (3) above, preferably, the control unit counts a number of times the determination result of the pressure increase determination has consecutively become positive, as the number of times the pressure increase control has been consecutively performed.

In this case, the control unit can determine that the number of times the pressure increase control has been consecutively performed has exceeded the predetermined number of times, before outputting the pressure increase command to the fluid pressure adjustment unit. Accordingly, it is possible to quickly grasp that an abnormality has occurred in the fluid pressure adjustment unit.

(5) In the bellows pump device of (2) or (3) above, preferably, the control unit counts a number of times the determination result of the pressure decrease determination has consecutively become positive, as the number of times the pressure decrease control has been consecutively performed.

In this case, the control unit can determine that the number of times the pressure decrease control has been consecutively performed has exceeded the predetermined number of times, before outputting the pressure decrease command to the fluid pressure adjustment unit. Accordingly, it is possible to quickly grasp that an abnormality has occurred in the fluid pressure adjustment unit.

Advantageous Effects of the Invention

The bellows pump device of the present disclosure can grasp that an abnormality has occurred in the fluid pressure adjustment unit, with an inexpensive configuration.

DETAILED DESCRIPTION

Next, a preferred embodiment will be described with reference to the accompanying drawings.

[Entire Configuration]

Figure 1:
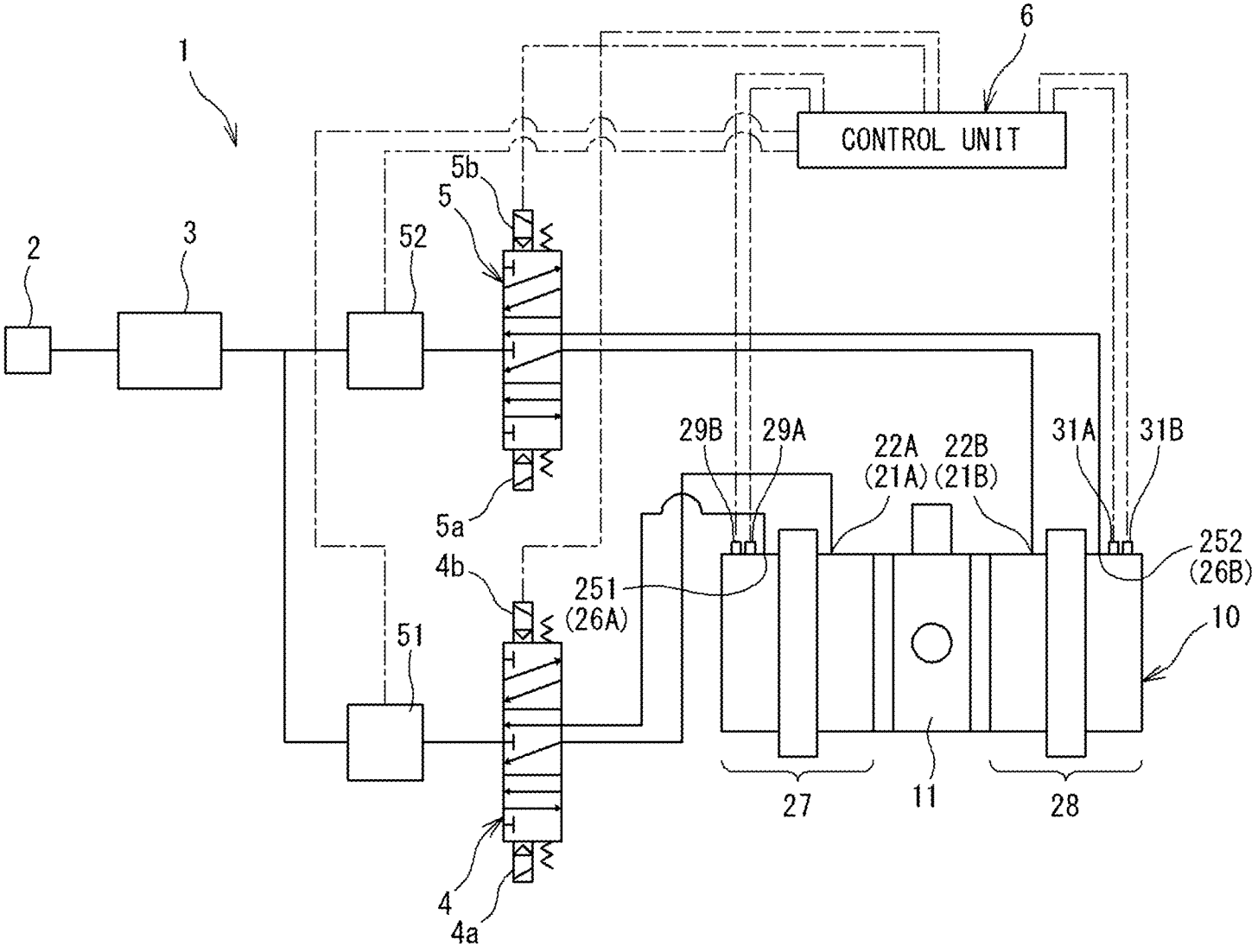
FIG. 1 is a schematic configuration diagram of a bellows pump device according to an embodiment.

FIG. 1 is a schematic configuration diagram of a bellows pump device 1 according to an embodiment. The bellows pump device 1 of the present embodiment is used, for example, in a semiconductor production apparatus when a transport fluid such as a chemical solution or a solvent is supplied in a certain amount. The bellows pump device 1 includes an air supply device (fluid supply device) 2, a mechanical regulator 3, a first solenoid valve 4, a second solenoid valve 5, a control unit 6, a bellows pump 10, a first electropneumatic regulator (fluid pressure adjustment unit) 51, and a second electropneumatic regulator (fluid pressure adjustment unit) 52.

The air supply device 2 is composed of, for example, an air compressor and generates pressurized air (pressurized fluid) to be supplied to the bellows pump 10. The mechanical regulator 3 adjusts the air pressure (fluid pressure) of the pressurized air generated by the air supply device 2. The first electropneumatic regulator 51 and the second electropneumatic regulator 52 will be described later.

Figure 2:
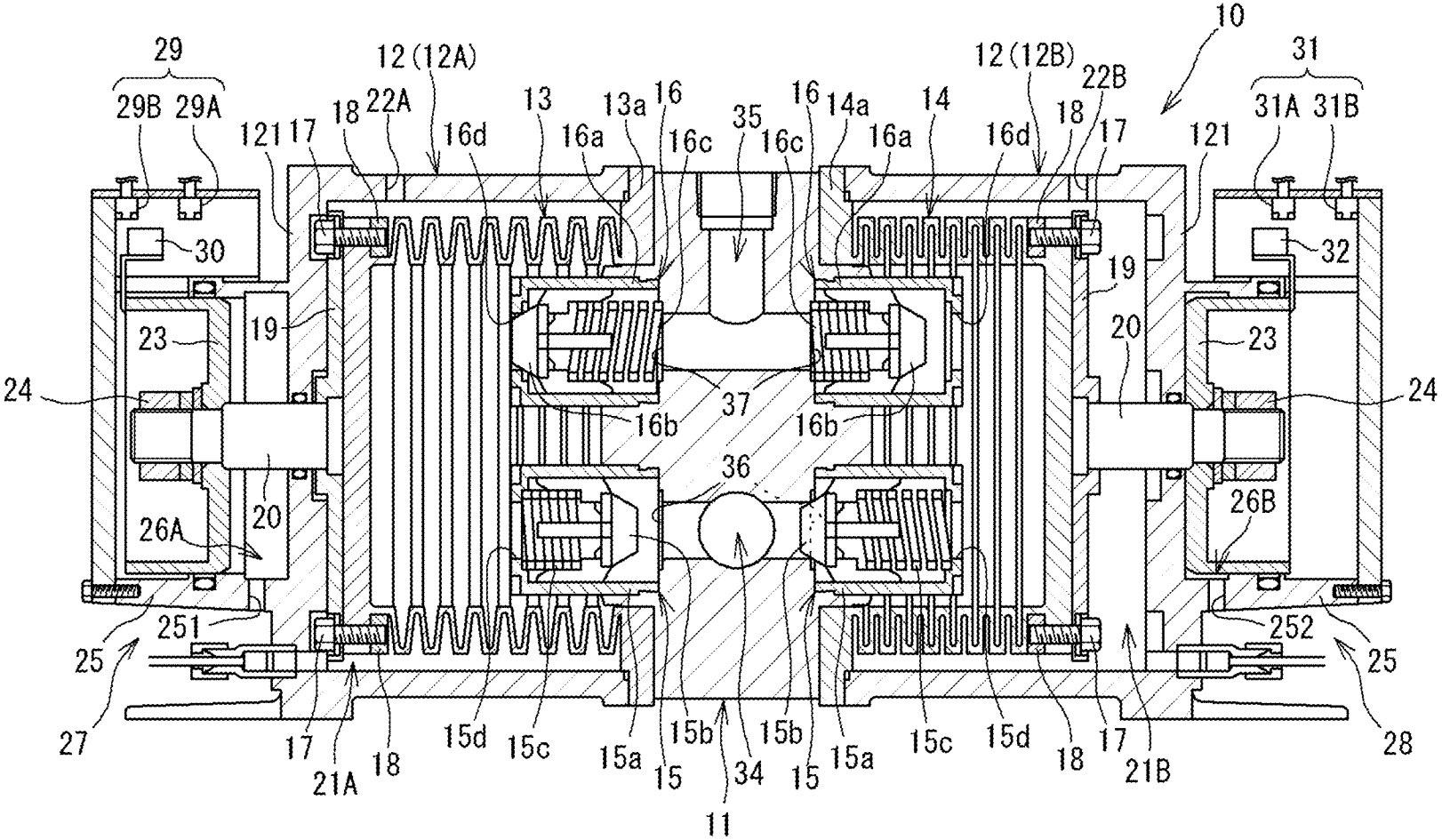
FIG. 2 is a cross-sectional view of a bellows pump.

FIG. 2 is a cross-sectional view of the bellows pump 10 according to the present embodiment. The bellows pump 10 of the present embodiment includes: a pump head 11 which is disposed at a center portion; a pair of pump cases 12 which are mounted on both sides of the pump head 11 in a right-left direction; a first bellows 13 and a second bellows 14 which are a pair of bellows mounted on side surfaces of the pump head 11 in the right-left direction and within the respective pump cases 12; and a total of four check valves 15 and check valves 16 which are mounted on the side surfaces of the pump head 11 in the right-left direction and within the respective first and second bellows 13 and 14.

[Bellows]

The first bellows 13 and the second bellows 14 are each formed in a bottomed cylindrical shape from a fluorine resin such as polytetrafluoroethylene (PTFE) or a tetrafluoroethylene-perfluoro alkyl vinyl ether copolymer (PFA). A flange portion 13*a* and a flange portion 14*a* are integrally formed at open-side end portions of the first and second bellows 13 and 14 and are hermetically pressed and fixed to the side surfaces of the pump head 11. Peripheral walls of the first and second bellows 13 and 14 are each formed in an accordion shape, and are configured to be expandable/contractible independently of each other in the right-left direction.

A working plate 19 is fixed to each of the outer surfaces of closed-side end portions of the first and second bellows 13 and 14 by bolts 17 and nuts 18. Each of the first and second bellows 13 and 14 is expandable/contractible between a most expanded state where the outer surface of the working plate 19 is in contact with the inner surface of a bottom wall portion 121 of the pump case 12 having a bottomed cylindrical shape and a most contracted state where the inner surface of a piston body 23 described later is in contact with the outer surface of the bottom wall portion 121.

[Pump Cases]

An opening peripheral portion of the pump case 12 (hereinafter, also referred to as "first pump case 12A") is hermetically pressed and fixed to the flange portion 13*a* of the first bellows 13. Accordingly, a first discharge-side air chamber (discharge-side fluid chamber) 21A is formed on the outer side of the first bellows 13 within the first pump case 12A such that a hermetic state thereof is maintained.

A first suction/discharge port 22A is provided in the first pump case 12A and connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first discharge-side air chamber 21A, the first bellows 13 contracts to a predetermined contracted state (hereinafter, simply referred to as "contracted state"). The contracted state of the first bellows 13 may be the most contracted state or may be a state before the most contracted state.

An opening peripheral portion of the pump case 12 (hereinafter, also referred to as "second pump case 12B") is hermetically pressed and fixed to the flange portion 14*a* of the second bellows 14. Accordingly, a second discharge-side air chamber (discharge-side fluid chamber) 21B is formed on the outer side of the second bellows 14 within the second pump case 12B such that a hermetic state thereof is maintained.

A second suction/discharge port 22B is provided in the second pump case 12B and connected to the air supply device 2 via the second solenoid valve 5, the second electropneumatic regulator 52, and the mechanical regulator 3 (see FIG. 1). Accordingly, when the pressurized air is supplied from the air supply device 2 to the interior of the second discharge-side air chamber 21B, the second bellows 14 contracts to a predetermined contracted state (hereinafter, simply referred to as "contracted state"). The contracted state of the second bellows 14 may be the most contracted state or may be a state before the most contracted state.

A rod-shaped connection member 20 penetrates the bottom wall portion 121 of each pump case 12A, 12B and is supported so as to be slidable in the right-left direction relative to the bottom wall portion 121. The piston body 23 is fixed to an outer end portion of the connection member 20 by a nut 24. The piston body 23 is supported so as to be slidable in the right-left direction relative to an inner circumferential surface of a cylindrical cylinder body 25, which is integrally provided on the outer side of the bottom wall portion 121, with a hermetic state maintained.

Accordingly, on the first pump case 12A side, a space surrounded by the bottom wall portion 121, the cylinder body 25, and the piston body 23 is formed as a first suction-side air chamber (suction-side fluid chamber) 26A of which a hermetic state is maintained. In addition, on the second pump case 12B side, a space surrounded by the bottom wall portion 121, the cylinder body 25, and the piston body 23 is formed as a second suction-side air chamber (suction-side fluid chamber) 26B of which a hermetic state is maintained.

In the cylinder body 25 on the first pump case 12A side, a suction/discharge port 251 is formed so as to communicate with the first suction-side air chamber 26A. The suction/discharge port 251 is connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first suction-side air chamber 26A via the suction/discharge port 251, the first bellows 13 expands to a predetermined expanded state (hereinafter, simply referred to as "expanded state"). The expanded state of the first bellows 13 may be the most expanded state or may be a state before the most expanded state.

In the cylinder body 25 on the second pump case 12B side, a suction/discharge port 252 is formed so as to communicate with the second suction-side air chamber 26B. The suction/discharge port 252 is connected to the air supply device 2 via the second solenoid valve 5, the second electropneumatic regulator 52, and the mechanical regulator 3 (see FIG. 1). Accordingly, when the pressurized air is supplied from the air supply device 2 to the interior of the second suction-side air chamber 26B via the suction/discharge port 252, the second bellows 14 expands to a predetermined expanded state (hereinafter, simply referred to as "expanded state"). The expanded state of the second bellows 14 may be the most expanded state or may be a state before the most expanded state.

Because of the above configuration, the first pump case 12A, in which the first discharge-side air chamber 21A is formed, and the piston body 23 and the cylinder body 25 which form the first suction-side air chamber 26A, form a first driving unit (driving unit) 27 which causes the first bellows 13 to perform expansion/contraction operation continuously between the expanded state and the contracted state.

In addition, the second pump case 12B, in which the second discharge-side air chamber 21B is formed, and the piston body 23 and the cylinder body 25 which form the second suction-side air chamber 26B, form a second driving unit (driving unit) 28 which causes the second bellows 14 to perform expansion/contraction operation continuously between the expanded state and the contracted state.

[Detection Units]

A pair of a proximity sensor 29A and a proximity sensor 29B are mounted on the cylinder body 25 of the first driving unit 27. A detection plate 30 to be detected by each of the proximity sensors 29A and 29B is mounted on the piston body 23 of the first driving unit 27. The detection plate 30 reciprocates together with the piston body 23, whereby the detection plate 30 alternately comes close to the proximity sensors 29A and 29B.

The proximity sensor 29A is disposed at a position where the proximity sensor 29A detects the detection plate 30 when the first bellows 13 is in a mid-contraction state before the contracted state. The proximity sensor 29B is disposed at a position where the proximity sensor 29B detects the detection plate 30 when the first bellows 13 is in the expanded state. When the respective proximity sensors 29A and 29B detect the detection plate 30, the proximity sensors 29A and 29B output detection signals thereof to the control unit 6. The pair of proximity sensors 29A and 29B function as a first detection unit (detection unit) 29 which detects an expanded/contracted state of the first bellows 13.

A pair of a proximity sensor 31A and a proximity sensor 31B are mounted on the cylinder body 25 of the second driving unit 28. A detection plate 32 to be detected by each of the proximity sensors 31A and 31B is mounted on the piston body 23 of the second driving unit 28. The detection plate 32 reciprocates together with the piston body 23, whereby the detection plate 32 alternately comes close to the proximity sensors 31A and 31B.

The proximity sensor 31A is disposed at a position where the proximity sensor 31A detects the detection plate 32 when the second bellows 14 is in a mid-contraction state before the contracted state. The proximity sensor 31B is disposed at a position where the proximity sensor 31B detects the detection plate 32 when the second bellows 14 is in the expanded state. When the respective proximity sensors 31A and 31B detect the detection plate 32, the proximity sensors 31A and 31B output detection signals thereof to the control unit 6. The pair of proximity sensors 31A and 31B function as a second detection unit (detection unit) 31 which detects an expanded/contracted state of the second bellows 14.

Here, the "mid-contraction state" of the first bellows 13 (second bellows 14) means that a contraction progress position of the first bellows 13 (second bellows 14) is closer to a contraction end position (contracted state) than to a contraction start position (expanded state), and more specifically means a position where the first bellows 13 (second bellows 14) has contracted up to 50% to 90% of a contraction length from the expanded state to the contracted state.

[Pump Head]

The pump head 11 is formed from a fluorine resin such as PTFE or PFA. A suction passage 34 and a discharge passage 35 for the transport fluid are formed within the pump head 11. The suction passage 34 and the discharge passage 35 are opened in an outer peripheral surface of the pump head 11 and are respectively connected to a suction port and a discharge port (both are not shown) provided at the outer peripheral surface.

The suction port is connected to a storage tank for the transport fluid or the like, and the discharge port is connected to a transport destination for the transport fluid. In addition, the suction passage 34 and the discharge passage 35 each branch toward both right and left side surfaces of the pump head 11, and have suction openings 36 and discharge openings 37 which are opened in both right and left side surfaces of the pump head 11. Each suction opening 36 and each discharge opening 37 communicate with the interior of the bellows 13 or 14 via the check valves 15 and 16, respectively.

[Check Valves]

The check valves 15 and 16 are provided at each suction opening 36 and each discharge opening 37.

The check valve 15 (hereinafter, also referred to as "suction check valve") mounted at each suction opening 36 includes: a valve case 15*a*; a valve body 15*b* which is housed in the valve case 15*a*; and a compression coil spring 15*c* which biases the valve body 15*b* in a valve closing direction.

The valve case 15*a* is formed in a bottomed cylindrical shape. A through hole 15*d* is formed in a bottom wall of the valve case 15*a* so as to communicate with the interior of the bellows 13 or 14. The valve body 15*b* closes the suction opening 36 (performs valve closing) by the biasing force of the compression coil spring 15*c*, and opens the suction opening 36 (performs valve opening) when a back pressure generated by flow of the transport fluid occurring with expansion/contraction of the bellows 13 or 14 acts thereon.

Accordingly, the suction check valve 15 opens, when the bellows 13 or 14 at which the suction check valve 15 is disposed expands, to permit suction of the transport fluid in a direction from the suction passage 34 toward the interior of the bellows 13 or 14 (in one direction). In addition, the suction check valve 15 closes, when the bellows 13 or 14 at which the suction check valve 15 is disposed contracts, to block backflow of the transport fluid in a direction from the interior of the bellows 13 or 14 toward the suction passage 34 (in another direction). The check valve 16 (hereinafter, also referred to as "discharge check valve") mounted at each discharge opening 37 includes: a valve case 16*a*; a valve body 16*b* which is housed in the valve case 16*a*; and a compression coil spring 16*c* which biases the valve body 16*b* in a valve closing direction.

The valve case 16*a* is formed in a bottomed cylindrical shape. A through hole 16*d* is formed in a bottom wall of the valve case 16*a* so as to communicate with the interior of the bellows 13 or 14. The valve body 16*b* closes the through hole 16*d* of the valve case 16*a* (performs valve closing) by the biasing force of the compression coil spring 16*c*, and opens the through hole 16*d* of the valve case 16*a* (performs valve opening) when a back pressure generated by flow of the transport fluid occurring with expansion/contraction of the bellows 13 or 14 acts thereon.

Accordingly, the discharge check valve 16 opens, when the bellows 13 or 14 at which the discharge check valve 16 is disposed contracts, to permit outflow of the transport fluid in a direction from the interior of the bellows 13 or 14 toward the discharge passage 35 (in one direction). In addition, the discharge check valve 16 closes, when the bellows 13 or 14 at which the discharge check valve 16 is disposed expands, to block backflow of the transport fluid in a direction from the discharge passage 35 toward the interior of the bellows 13 or 14 (in another direction).

[Operation of Bellows Pump]

Figure 3:
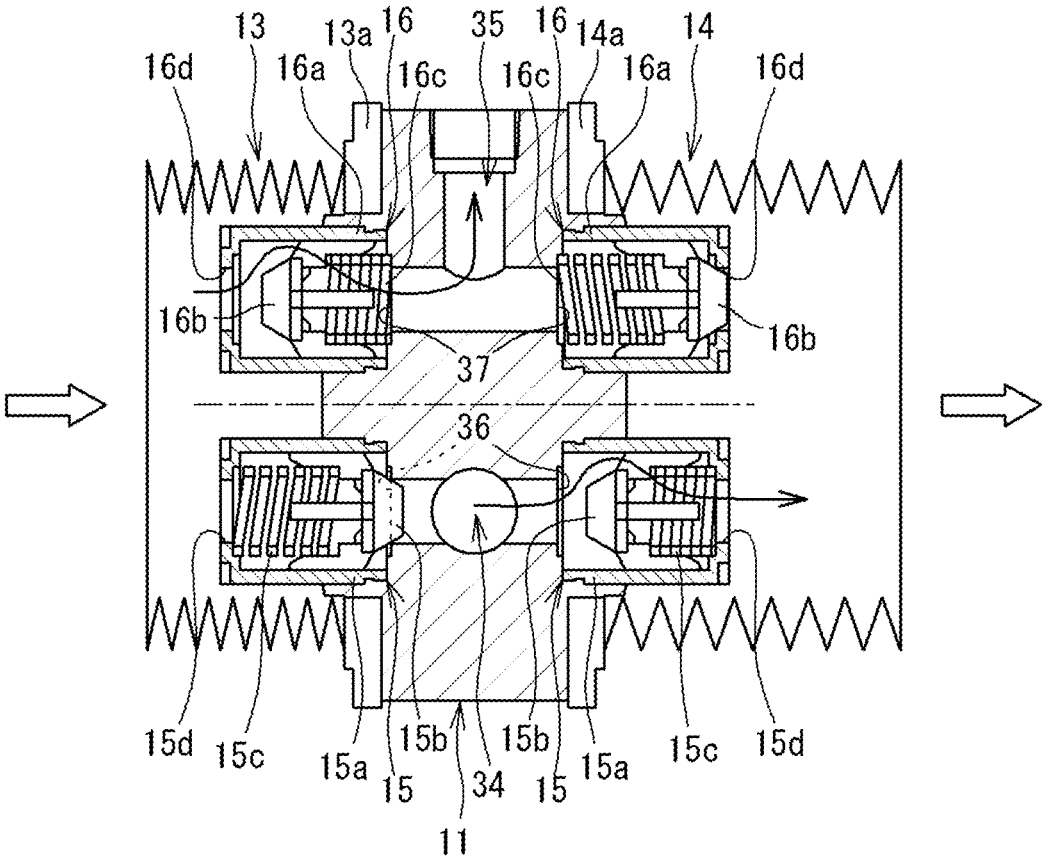
FIG. 3 is an explanatory diagram showing operation of the bellows pump.
Figure 4:
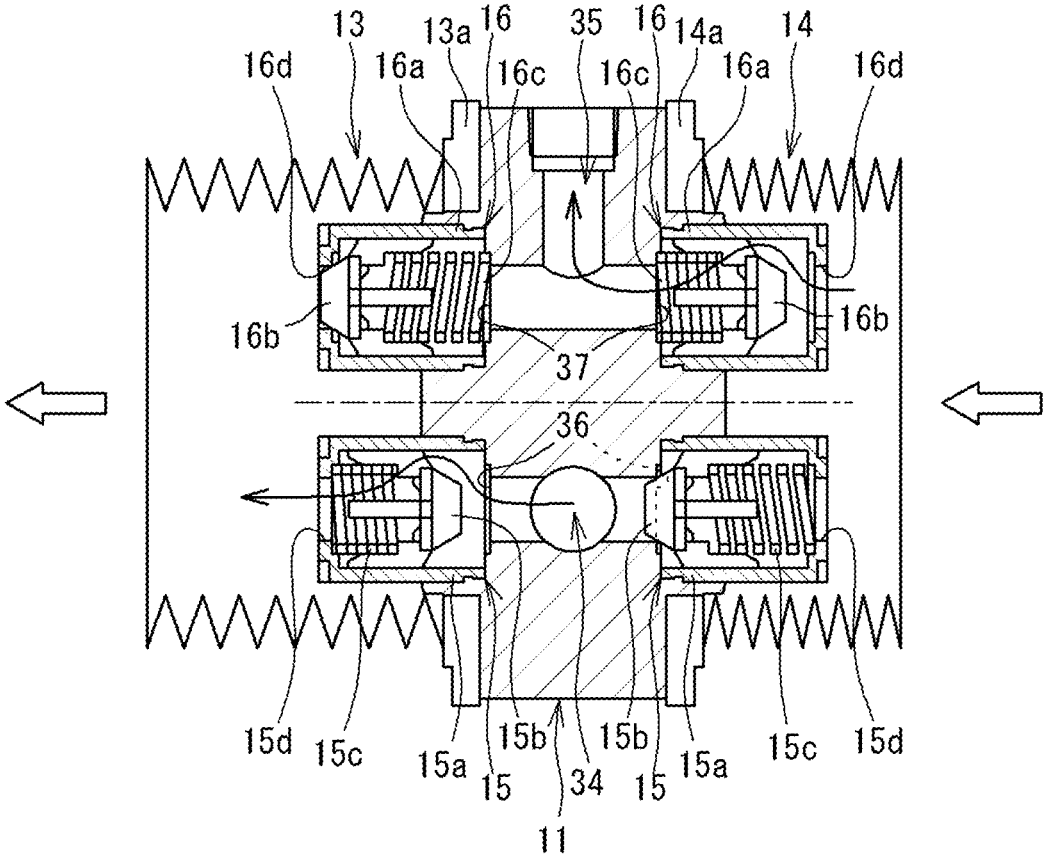
FIG. 4 is an explanatory diagram showing operation of the bellows pump.

Next, operation of the bellows pump 10 of the present embodiment will be described with reference to FIG. 3 and FIG. 4. In FIG. 3 and FIG. 4, the configurations of the first and second bellows 13 and 14 are shown in a simplified manner. As shown in FIG. 3, when the first bellows 13 contracts and the second bellows 14 expands, the respective valve bodies 15*b* and 16*b* of the suction check valve 15 and the discharge check valve 16 that are mounted on the left side of the pump head 11 in the drawing receive pressure from the transport fluid within the first bellows 13 and move to the right sides of the respective valve cases 15*a* and 16*a* in the drawing. Accordingly, the suction check valve 15 closes, and the discharge check valve 16 opens, so that the transport fluid within the first bellows 13 is discharged through the discharge passage 35 to the outside of the pump.

Meanwhile, the valve body 15*b* of the suction check valve 15 mounted on the right side of the pump head 11 in the drawing moves to the right side of the valve case 15*a* in the drawing due to a suction action by the second bellows 14. The valve body 16*b* of the discharge check valve 16 mounted on the right side of the pump head 11 in the drawing moves to the right side of the valve case 16*a* in the drawing due to a suction action by the second bellows 14 and a pressing action by the transport fluid discharged from the first bellows 13 to the discharge passage 35. Accordingly, the suction check valve 15 opens, and the discharge check valve 16 closes, so that the transport fluid is sucked from the suction passage 34 into the second bellows 14.

Next, as shown in FIG. 4, when the first bellows 13 expands and the second bellows 14 contracts, the respective valve bodies 15*b* and 16*b* of the suction check valve 15 and the discharge check valve 16 that are mounted on the right side of the pump head 11 in the drawing receive pressure from the transport fluid within the second bellows 14 and move to the left sides of the respective valve cases 15*a* and 16*a* in the drawing. Accordingly, the suction check valve 15 closes, and the discharge check valve 16 opens, so that the transport fluid within the second bellows 14 is discharged through the discharge passage 35 to the outside of the pump.

Meanwhile, the valve body 15*b* of the suction check valve 15 mounted on the left side of the pump head 11 in the drawing moves to the left side of the valve case 15*a* in the drawing due to a suction action by the first bellows 13. The valve body 16*b* of the discharge check valve 16 mounted on the left side of the pump head 11 in the drawing moves to the left side of the valve case 16*a* in the drawing due to a suction action by the first bellows 13 and a pressing action by the transport fluid discharged from the first bellows 13 to the discharge passage 35. Accordingly, the suction check valve 15 opens, and the discharge check valve 16 closes, so that the transport fluid is sucked from the suction passage 34 into the first bellows 13.

By repeatedly performing the above operation, the left and right bellows 13 and 14 can alternately suck and discharge the transport fluid.

[Solenoid Valves]

In FIG. 1, the first solenoid valve 4 is composed of, for example, a three-position solenoid switching valve including a pair of a solenoid 4*a* and a solenoid 4*b*. Each of the solenoids 4*a* and 4*b* is configured to be magnetized on the basis of a command signal received from the control unit 6. Accordingly, the first solenoid valve 4 is switched and controlled by the control unit 6. The first solenoid valve 4 switches between supply/discharge of the pressurized air to/from the first discharge-side air chamber 21A and supply/discharge of the pressurized air to/from the first suction-side air chamber 26A in the first driving unit 27.

Specifically, when the solenoid 4*a* is magnetized, the first solenoid valve 4 switches to a state where the pressurized air is supplied to the first discharge-side air chamber 21A and the pressurized air within the first suction-side air chamber 26A is discharged. In addition, when the solenoid 4*b* is magnetized, the first solenoid valve 4 switches to a state where the pressurized air within the first discharge-side air chamber 21A is discharged and the pressurized air is supplied to the first suction-side air chamber 26A.

The second solenoid valve 5 is composed of, for example, a three-position solenoid switching valve including a pair of a solenoid 5*a* and a solenoid 5*b*. Each of the solenoids 5*a* and 5*b* is configured to be magnetized upon reception of a command signal from the control unit 6. Accordingly, the second solenoid valve 5 is switched and controlled by the control unit 6. The second solenoid valve 5 switches between supply/discharge of the pressurized air to/from the second discharge-side air chamber 21B and supply/discharge of the pressurized air to/from the second suction-side air chamber 26B in the second driving unit 28.

Specifically, when the solenoid 5*a* is magnetized, the second solenoid valve 5 switches to a state where the pressurized air is supplied to the second discharge-side air chamber 21B and the pressurized air within the second suction-side air chamber 26B is discharged. In addition, when the solenoid 5*b* is magnetized, the second solenoid valve 5 switches to a state where the pressurized air within the second discharge-side air chamber 21B is discharged and the pressurized air is supplied to the second suction-side air chamber 26B.

Although each of the first and second solenoid valves 4 and 5 of the present embodiment is composed of the three-position solenoid switching valve, each of the first and second solenoid valves 4 and 5 may be a two-position solenoid switching valve which does not have a neutral position.

[Electropneumatic Regulators]

The first electropneumatic regulator 51 is disposed between the mechanical regulator 3 and the first solenoid valve 4. The first electropneumatic regulator 51 adjusts the air pressure of the pressurized air to be supplied to the first suction-side air chamber 26A of the first driving unit 27 and the air pressure of the pressurized air to be supplied to the first discharge-side air chamber 21A of the first driving unit 27.

The second electropneumatic regulator 52 is disposed between the mechanical regulator 3 and the second solenoid valve 5. The second electropneumatic regulator 52 adjusts the air pressure of the pressurized air to be supplied to the second suction-side air chamber 26B of the second driving unit 28 and the air pressure of the pressurized air to be supplied to the second discharge-side air chamber 21B of the second driving unit 28.

The electropneumatic regulators 51 and 52 only have to adjust at least the air pressure of the pressurized air to be supplied to the suction-side air chambers 26A and 26B. In addition, in the present embodiment, the electropneumatic regulators 51 and 52, which directly adjust the air pressure, are used as fluid pressure adjustment units, but the air pressure may be adjusted indirectly using an air flow rate adjusting valve which adjusts an air flow rate, or a device that adjusts the pressure or flow rate of a gas other than air (for example, nitrogen), a liquid, or the like may be used.

[Control Unit]

In FIG. 1 and FIG. 2, the control unit 6 is configured to include a computer having a CPU or the like. Each function of the control unit 6 is performed by the CPU executing a control program stored in a storage device of the computer. The control unit 6 controls the first driving unit 27, the second driving unit 28, the first electropneumatic regulator 51, and the second electropneumatic regulator 52 on the basis of the respective detection results of the first detection unit 29 and the second detection unit 31, respectively. These controls will be sequentially described below.

The control unit 6 performs drive control of controlling the first driving unit 27 and the second driving unit 28 by switching the first solenoid valve 4 and the second solenoid valve 5 on the basis of the respective detection results of the first detection unit 29 and the second detection unit 31, respectively.

Specifically, the control unit 6 controls each drive of the first driving unit 27 and the second driving unit 28 on the basis of the respective detection results of the first detection unit 29 and the second detection unit 31 such that the second bellows 14 is caused to contract from the expanded state before the first bellows 13 comes into the contracted state and the first bellows 13 is caused to contract from the expanded state before the second bellows 14 comes into the contracted state.

By the control unit 6 performing drive control as described above, at a time of switching from contraction of one bellows out of the first bellows 13 and the second bellows 14 to expansion thereof (from discharge of the transport fluid to suction thereof), the other bellows has already contracted to discharge the transport fluid. Thus, great fall of the discharge pressure of the transport fluid at the above time can be reduced. As a result, pulsation at the discharge side of the bellows pump 10 can be reduced.

In the above drive control, for example, if the atmospheric temperature falls, the first bellows 13 and the second bellows 14 may become harder due to the influence thereof, so that each of the expansion times of the first bellows 13 and the second bellows 14 may become longer. In this case, the control unit 6 performs pressure increase control for shortening the respective expansion times of the first bellows 13 and the second bellows 14 on the basis of the respective detection results of the first detection unit 29 and the second detection unit 31. As the pressure increase control, the control unit 6 performs a pressure increase determination, and outputs a pressure increase command on the basis of the determination result thereof.

Specifically, the control unit 6 performs a pressure increase determination of determining whether or not the second bellows 14 (first bellows 13) is in the middle of expansion when the first bellows 13 (second bellows 14) contracts to the mid-contraction state, on the basis of the respective detection results of the first detection unit 29 and the second detection unit 31. When the determination result of the pressure increase determination is positive (being in the middle of expansion), the control unit 6 outputs a pressure increase command to the second electropneumatic regulator 52 (first electropneumatic regulator 51) such that the air pressure of the pressurized air to be supplied to the second suction-side air chamber 26B (first suction-side air chamber 26A) at the next expansion of the second bellows 14 (first bellows 13) is increased. The pressure increase command includes a degree of increase in the air pressure. The degree of increase is preferably +1 kPa to +50 kPa (more preferably +1 kPa to +20 kPa).

Meanwhile, in the above drive control, for example, if the atmospheric temperature rises, the first bellows 13 and the second bellows 14 may become softer due to the influence thereof, so that each of the expansion times of the first bellows 13 and the second bellows 14 may become shorter. In this case, the control unit 6 performs pressure decrease control for lengthening the respective expansion times of the first bellows 13 and the second bellows 14 on the basis of the respective detection results of the first detection unit 29 and the second detection unit 31. As the pressure decrease control, the control unit 6 performs a pressure decrease determination, and outputs a pressure decrease command on the basis of the determination result thereof.

Specifically, the control unit 6 performs a pressure decrease determination of determining whether or not the second bellows 14 (first bellows 13) has continued to be in the expanded state for a predetermined time or longer when the first bellows 13 (second bellows 14) contracts to the mid-contraction state, on the basis of the respective detection results of the first detection unit 29 and the second detection unit 31. The predetermined time is preferably set to a value of, for example, 500 msec (preferably 10 to 200 msec).

When the determination result of the pressure decrease determination is positive (having continued to be in the expanded state for the predetermined time or longer), the control unit 6 outputs a pressure decrease command to the second electropneumatic regulator 52 (first electropneumatic regulator 51) such that the air pressure of the pressurized air to be supplied to the second suction-side air chamber 26B (first suction-side air chamber 26A) at the next expansion of the second bellows 14 (first bellows 13) is decreased. The pressure decrease command includes a degree of decrease in the air pressure. The degree of decrease is preferably −1 kPa to −50 kPa (more preferably −1 kPa to −20 kPa).

[Specific Example of Pressure Increase Control]

Figure 5:
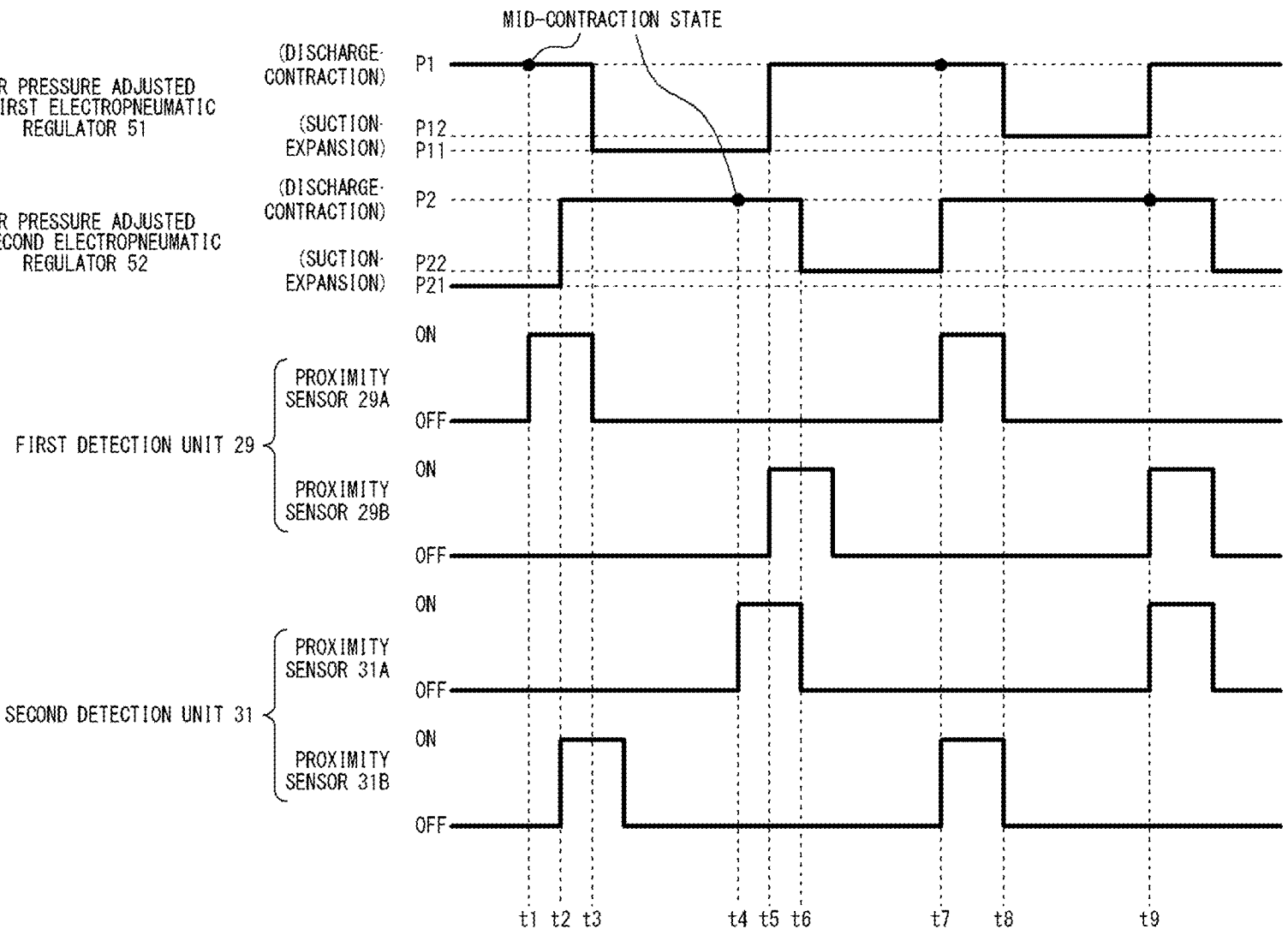
FIG. 5 is a time chart showing an example of pressure increase control.

FIG. 5 is a time chart showing an example of pressure increase control performed by the control unit 6 during drive control. Hereinafter, the drive control and the pressure increase control executed by the control unit 6 will be described with reference to FIG. 1 and FIG. 5. Here, a description from a state where the first bellows 13 is in the middle of contraction (discharge) and the second bellows 14 is in the middle of expansion (suction) will be given.

At time t1 at which the proximity sensor 29A detects the mid-contraction state of the first bellows 13 (is turned ON), the control unit 6 determines whether or not the second bellows 14 is in the middle of expansion (pressure increase determination). This determination is performed on the basis of whether the proximity sensor 31B has not detected the expanded state of the second bellows 14 (has been OFF) at time t1. Here, at time t1, the proximity sensor 31B has not detected the expanded state of the second bellows 14, and thus the control unit 6 determines that the second bellows 14 is in the middle of expansion. Due to this determination result, the control unit 6 outputs the pressure increase command at the next expansion of the second bellows 14 (time t6 to time t7) as described later.

When the control unit 6 determines that the proximity sensor 31B has not been turned ON, the control unit 6 waits until the proximity sensor 31B is turned ON. Then, at time t2 at which the proximity sensor 31B is turned ON, the control unit 6 demagnetizes the solenoid 5*b* of the second solenoid valve 5 and magnetizes the solenoid 5*a*. When the control unit 6 determines at time t1 that the proximity sensor 31B has been turned ON, the control unit 6 immediately demagnetizes the solenoid 5*b* of the second solenoid valve 5 and magnetizes the solenoid 5*a*.

When the solenoid 5*a* of the second solenoid valve 5 is magnetized, the pressurized air generated by the air supply device 2 is supplied to the second discharge-side air chamber 21B of the second driving unit 28 via the mechanical regulator 3, the second electropneumatic regulator 52, and the second solenoid valve 5. At this time, the control unit 6 outputs a control command to the second electropneumatic regulator 52 such that the air pressure of the pressurized air to be supplied to the second discharge-side air chamber 21B reaches a predetermined value P2. Accordingly, the second bellows 14 starts contraction operation from the expanded state before the first bellows 13 comes into the contracted state.

After the second bellows 14 starts contraction operation, at time t3 at which a predetermined calculation time elapses from time t1 at which the proximity sensor 29A is turned ON, the control unit 6 determines that the first bellows 13 comes into the contracted state. Then, the control unit 6 demagnetizes the solenoid 4*a* of the first solenoid valve 4 and magnetizes the solenoid 4*b*.

When the solenoid 4*b* of the first solenoid valve 4 is magnetized, the pressurized air generated by the air supply device 2 is supplied to the first suction-side air chamber 26A of the first driving unit 27 via the mechanical regulator 3, the first electropneumatic regulator 51, and the first solenoid valve 4. At this time, the control unit 6 outputs a control command to the first electropneumatic regulator 51 such that the air pressure of the pressurized air to be supplied to the first suction-side air chamber 26A reaches a predetermined value P11. The first electropneumatic regulator 51 adjusts the air pressure of the pressurized air to be supplied to the first suction-side air chamber 26A, to reach the predetermined value P11 on the basis of the control command. Accordingly, the first bellows 13 starts expansion operation from the contracted state.

Next, at time t4 at which the proximity sensor 31A detects the mid-contraction state of the second bellows 14 (is turned ON), the control unit 6 determines whether or not the first bellows 13 is in the middle of expansion (pressure increase determination). This determination is performed on the basis of whether the proximity sensor 29B has not detected the expanded state of the first bellows 13 (has been OFF) at time t4. Here, at time t4, the proximity sensor 29B has not detected the expanded state of the first bellows 13, and thus the control unit 6 determines that the first bellows 13 is in the middle of expansion. Due to this determination result, the control unit 6 outputs the pressure increase command at the next expansion of the first bellows 13 (time t8 to time t9) as described later.

When the control unit 6 determines that the proximity sensor 29B has not been turned ON, the control unit 6 waits until the proximity sensor 29B is turned ON. Then, at time t5 at which the proximity sensor 29B is turned ON, the control unit 6 demagnetizes the solenoid 4*b* of the first solenoid valve 4 and magnetizes the solenoid 4*a*. When the control unit 6 determines at time t4 that the proximity sensor 29B has been turned ON, the control unit 6 immediately demagnetizes the solenoid 4*b* of the first solenoid valve 4 and magnetizes the solenoid 4*a*.

When the solenoid 4*a* of the first solenoid valve 4 is magnetized, the pressurized air generated by the air supply device 2 is supplied to the first discharge-side air chamber 21A of the first driving unit 27 via the mechanical regulator 3, the first electropneumatic regulator 51, and the first solenoid valve 4. At this time, the control unit 6 outputs a control command to the first electropneumatic regulator 51 such that the air pressure of the pressurized air to be supplied to the first discharge-side air chamber 21A reaches a predetermined value P1. The first electropneumatic regulator 51 adjusts the air pressure of the pressurized air to be supplied to the first discharge-side air chamber 21A, to reach the predetermined value P1 on the basis of the control command. Accordingly, the first bellows 13 starts contraction operation from the expanded state before the second bellows 14 comes into the contracted state.

After the first bellows 13 starts contraction operation, at time t6 at which a predetermined time elapses from the time t4 at which the proximity sensor 31A is turned ON, the control unit 6 determines that the second bellows 14 comes into the contracted state. Then, the control unit 6 demagnetizes the solenoid 5*a* of the second solenoid valve 5 and magnetizes the solenoid 5*b*.

When the solenoid 5*b* of the second solenoid valve 5 is magnetized, the pressurized air generated by the air supply device 2 is supplied to the second suction-side air chamber 26B of the second driving unit 28 via the mechanical regulator 3, the second electropneumatic regulator 52, and the second solenoid valve 5. At this time, since the determination result of the pressure increase determination performed at time t1 is positive (non-detection by the proximity sensor 31B is determined), the control unit 6 outputs the pressure increase command to the second electropneumatic regulator 52 such that the air pressure of the pressurized air to be supplied to the second suction-side air chamber 26B is increased.

Specifically, the control unit 6 outputs the pressure increase command to the second electropneumatic regulator 52 such that the air pressure of the pressurized air to be supplied to the second suction-side air chamber 26B reaches a value P22 which is higher than a value P21 at the last time (before time t2). The second electropneumatic regulator 52 adjusts the air pressure of the pressurized air to be supplied to the second suction-side air chamber 26B, to reach the value P22 on the basis of the pressure increase command. Accordingly, the second bellows 14 starts expansion operation from the contracted state. The expansion speed thereof becomes higher than the expansion speed of the second bellows 14 at the last time.

Next, at time t7 at which the proximity sensor 29A detects the mid-contraction state of the first bellows 13 (is turned ON), the control unit 6 determines whether or not the second bellows 14 is in the middle of expansion (pressure increase determination). Here, the expansion speed of the second bellows 14 becomes higher as described above, shortening the expansion time of the second bellows 14, whereby the second bellows 14 reaches the expanded state at time t7. Therefore, at time t7, the proximity sensor 31B detects the expanded state of the second bellows 14 (is turned ON), and thus the control unit 6 determines that the second bellows 14 is not in the middle of expansion. Due to this determination result, the control unit 6 does not output the pressure increase command at the next expansion of the second bellows 14.

When the control unit 6 determines that the proximity sensor 31B has been turned ON, the control unit 6 demagnetizes the solenoid 5*b* of the second solenoid valve 5 and magnetizes the solenoid 5*a*. When the solenoid 5*a* of the second solenoid valve 5 is magnetized, the second bellows 14 starts contraction operation from the expanded state before the first bellows 13 comes into the contracted state (while the first bellows 13 is in the mid-contraction state) as described above.

After the second bellows 14 starts contraction operation, at time t8 at which a predetermined calculation time elapses from time t7 at which the proximity sensor 29A is turned ON, the control unit 6 determines that the first bellows 13 comes into the contracted state, and the control unit 6 demagnetizes the solenoid 4*a* of the first solenoid valve 4 and magnetizes the solenoid 4*b*. When the solenoid 4*b* of the first solenoid valve 4 is magnetized, the pressurized air generated by the air supply device 2 is supplied to the first suction-side air chamber 26A of the first driving unit 27 as described above.

At this time, since the determination result of the pressure increase determination performed at time t4 is positive (non-detection by the proximity sensor 29B is determined), the control unit 6 outputs the pressure increase command to the first electropneumatic regulator 51 such that the air pressure of the pressurized air to be supplied to the first suction-side air chamber 26A is increased.

Specifically, the control unit 6 outputs the pressure increase command to the first electropneumatic regulator 51 such that the air pressure of the pressurized air supplied to the first suction-side air chamber 26A reaches a value P12 which is higher than the value P11 at the last time (time t3 to time t5). The first electropneumatic regulator 51 adjusts the air pressure of the pressurized air to be supplied to the first suction-side air chamber 26A, to reach the value P12 on the basis of the pressure increase command. Accordingly, the first bellows 13 starts expansion operation from the contracted state. The expansion speed thereof becomes higher than the expansion speed at the last expansion operation of the first bellows 13.

Next, at time t9 at which the proximity sensor 31A detects the mid-contraction state of the second bellows 14 (is turned ON), the control unit 6 determines whether or not the first bellows 13 is in the middle of expansion (pressure increase determination). Here, the expansion speed of the first bellows 13 becomes higher as described above, shortening the expansion time of the first bellows 13, whereby the first bellows 13 reaches the expanded state at time t9. Therefore, at time t9, the proximity sensor 29B detects the expanded state of the first bellows 13 (is turned ON), and thus the control unit 6 determines that the first bellows 13 is not in the middle of expansion. Due to this determination result, the control unit 6 does not output the pressure increase command at the next expansion of the first bellows 13.

When the control unit 6 determines that the proximity sensor 29B has been turned ON, the control unit 6 demagnetizes the solenoid 4*b* of the first solenoid valve 4 and magnetizes the solenoid 4*a*. When the solenoid 4*a* of the first solenoid valve 4 is magnetized, the first bellows 13 starts contraction operation from the expanded state before the second bellows 14 comes into the contracted state (while the second bellows 14 is in the mid-contraction state) as described above.

[Specific Example of Pressure Decrease Control]

Figure 6:
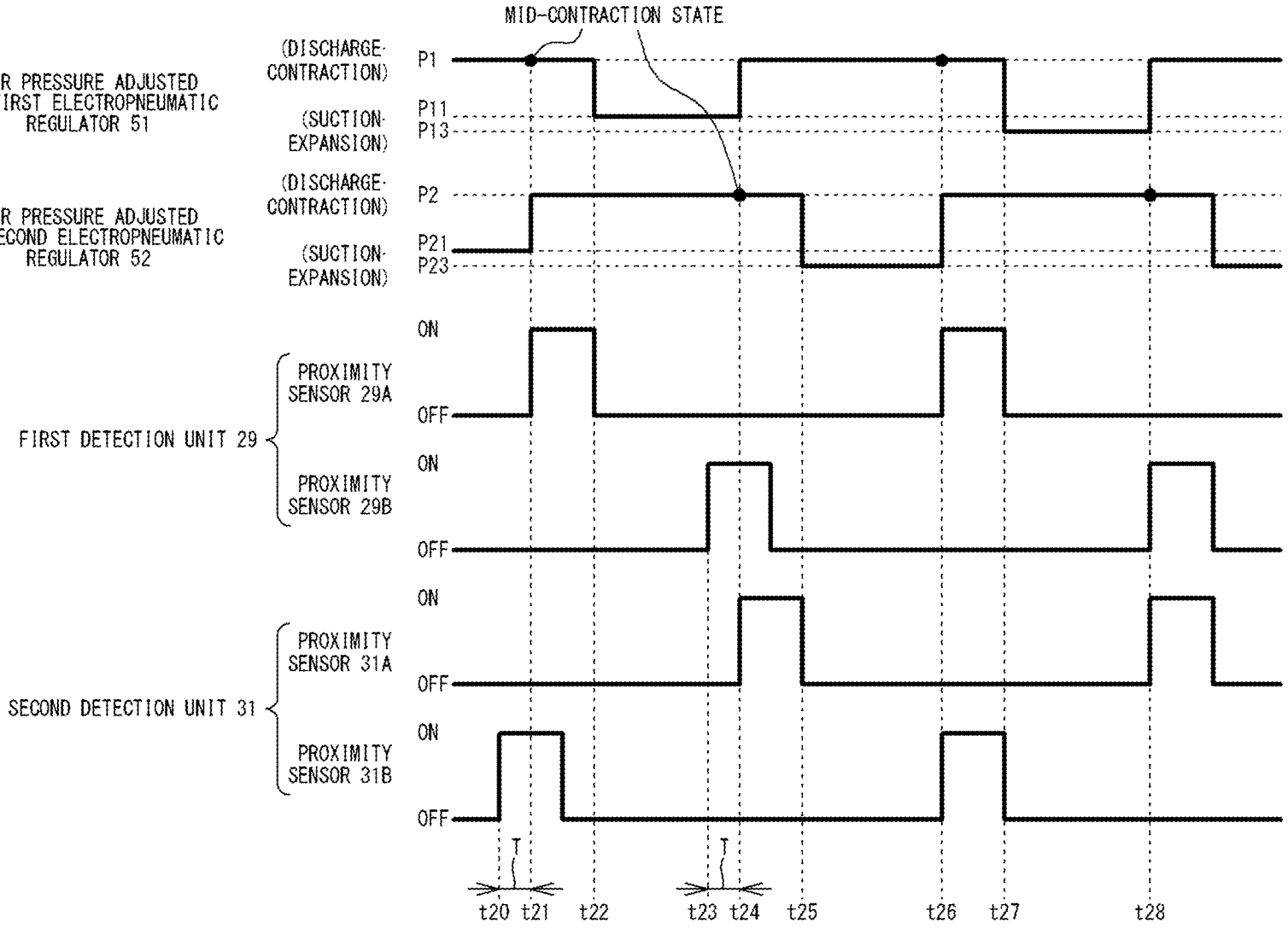
FIG. 6 is a time chart showing an example of pressure decrease control.

FIG. 6 is a time chart showing an example of pressure decrease control performed by the control unit 6 during drive control. Hereinafter, the pressure decrease control executed by the control unit 6 will be described with reference to FIG. 1 and FIG. 6. Here, as in FIG. 5, a description from a state where the first bellows 13 is in the middle of contraction (discharge) and the second bellows 14 is in the middle of expansion (suction) will be given.

The control unit 6 determines whether or not the proximity sensor 31B detects the expanded state of the second bellows 14 (is turned ON) before the proximity sensor 29A detects the mid-contraction state of the first bellows 13 (is turned ON). Here, at time t20 before the first bellows 13 reaches the mid-contraction state, the proximity sensor 31B detects the expanded state of the second bellows 14, and thus the control unit 6 determines that the proximity sensor 31B is turned ON.

When the control unit 6 determines that the proximity sensor 31B is turned ON, at time t21 at which the proximity sensor 29A detects the mid-contraction state of the first bellows 13, the control unit 6 further determines whether or not a predetermined time T or longer has elapsed from time t20 at which the proximity sensor 31B detects the expanded state of the second bellows 14 (pressure decrease determination). Here, at time t21, the predetermined time T elapses, and thus the control unit 6 determines that the predetermined time T or longer has elapsed from time t20. Due to this determination result, the control unit 6 outputs the pressure decrease command at the next expansion of the second bellows 14 (time t25 to time t26) as described later.

At time t21 at which the proximity sensor 29A is turned ON, the control unit 6 demagnetizes the solenoid 5*b* of the second solenoid valve 5 and magnetizes the solenoid 5*a*. When the solenoid 5*a* of the second solenoid valve 5 is magnetized, the second bellows 14 starts contraction operation from the expanded state before the first bellows 13 comes into the contracted state (while the first bellows 13 is in the mid-contraction state) as described above.

After the second bellows 14 starts contraction operation, at time t22 at which a predetermined calculation time elapses from time t21 at which the proximity sensor 29A is turned ON, the control unit 6 determines that the first bellows 13 comes into the contracted state. Then, the control unit 6 demagnetizes the solenoid 4*a* of the first solenoid valve 4 and magnetizes the solenoid 4*b*. When the solenoid 4*b* of the first solenoid valve 4 is magnetized, the first bellows 13 starts expansion operation from the contracted state as described above.

Next, the control unit 6 determines whether or not the proximity sensor 29B detects the expanded state of the first bellows 13 (is turned ON) before the proximity sensor 31A detects the mid-contraction state of the second bellows 14 (is turned ON). Here, at time t23 before the second bellows 14 reaches the mid-contraction state, the proximity sensor 29B detects the expanded state of the first bellows 13, and thus the control unit 6 determines that the proximity sensor 29B is turned ON.

When the control unit 6 determines that the proximity sensor 29B is turned ON, at time t24 at which the proximity sensor 31A detects the mid-contraction state of the second bellows 14, the control unit 6 further determines whether or not the predetermined time T or longer has elapsed from time t23 at which the proximity sensor 29B detects the expanded state of the first bellows 13 (pressure decrease determination). Here, at time t24, the predetermined time T elapses, and thus the control unit 6 determines that the predetermined time T or longer has elapsed from time t23. Due to this determination result, the control unit 6 outputs the pressure decrease command at the next expansion of the first bellows 13 (time t27 to time t28) as described later.

At time t24 at which the proximity sensor 31A is turned ON, the control unit 6 demagnetizes the solenoid 4*b* of the first solenoid valve 4 and magnetizes the solenoid 4*a*. When the solenoid 4*a* of the first solenoid valve 4 is magnetized, the first bellows 13 starts contraction operation from the expanded state before the second bellows 14 comes into the contracted state (while the second bellows 14 is in the mid-contraction state) as described above.

After the first bellows 13 starts contraction operation, at time t25 at which a predetermined calculation time elapses from time t24 at which the proximity sensor 31A is turned ON, the control unit 6 determines that the second bellows 14 comes into the contracted state. Then, the control unit 6 demagnetizes the solenoid 5*a* of the second solenoid valve 5 and magnetizes the solenoid 5*b*. When the solenoid 5*b* of the second solenoid valve 5 is magnetized, the pressurized air generated by the air supply device 2 is supplied to the second suction-side air chamber 26B of the second driving unit 28 as described above.

At this time, since the determination result of the pressure decrease determination performed at time t21 is positive (it is determined that the predetermined time T or longer has elapsed from time t20 at which the proximity sensor 31B is turned ON), the control unit 6 outputs the pressure decrease command to the second electropneumatic regulator 52 such that the air pressure of the pressurized air to be supplied to the second suction-side air chamber 26B is decreased.

Specifically, the control unit 6 outputs the pressure decrease command to the second electropneumatic regulator 52 such that the air pressure of the pressurized air to be supplied to the second suction-side air chamber 26B reaches a value P23 which is lower than a value P21 at the last time (before time t21). The second electropneumatic regulator 52 adjusts the air pressure of the pressurized air to be supplied to the second suction-side air chamber 26B, to reach the value P23 on the basis of the pressure decrease command. Accordingly, the second bellows 14 starts expansion operation from the contracted state. The expansion speed thereof becomes lower than the expansion speed at the last expansion operation of the second bellows 14.

Next, the control unit 6 determines whether or not the proximity sensor 31B detects the expanded state of the second bellows 14 (is turned ON) before the proximity sensor 29A detects the mid-contraction state of the first bellows 13 (is turned ON). Here, the expansion speed of the second bellows 14 becomes lower as described above, lengthening the expansion time of the second bellows 14, whereby the second bellows 14 reaches the expanded state at time t26 at which the first bellows 13 reaches the mid-contraction state.

Therefore, since the proximity sensor 31B does not detect the expanded state of the second bellows 14 (is OFF) before the first bellows 13 reaches the mid-contraction state, the control unit 6 determines that the proximity sensor 31B has not been turned ON. Due to this determination result, at time t26 at which the first bellows 13 reaches the mid-contraction state, the pressure decrease determination by the control unit 6 is not performed, and thus the pressure decrease command is not outputted at the next expansion of the second bellows 14.

At time t26 at which the proximity sensor 31B is turned ON, the control unit 6 demagnetizes the solenoid 5*b* of the second solenoid valve 5 and magnetizes the solenoid 5*a*. When the solenoid 5*a* of the second solenoid valve 5 is magnetized, the second bellows 14 starts contraction operation from the expanded state before the first bellows 13 comes into the contracted state (while the first bellows 13 is in the mid-contraction state) as described above.

After the second bellows 14 starts contraction operation, at time t27 at which a predetermined calculation time elapses from time t26 at which the proximity sensor 29A is turned ON, the control unit 6 determines that the first bellows 13 comes into the contracted state. Then, the control unit 6 demagnetizes the solenoid 4*a* of the first solenoid valve 4 and magnetizes the solenoid 4*b*. When the solenoid 4*b* of the first solenoid valve 4 is magnetized, the pressurized air generated by the air supply device 2 is supplied to the first suction-side air chamber 26A of the first driving unit 27 as described above.

At this time, since the determination result of the pressure decrease determination performed at time t24 is positive (it is determined that the predetermined time T or longer has elapsed from time t23 at which the proximity sensor 29B is turned ON), the control unit 6 outputs the pressure decrease command to the first electropneumatic regulator 51 such that the air pressure of the pressurized air to be supplied to the first suction-side air chamber 26A is decreased.

Specifically, the control unit 6 outputs a pressure decrease command to the first electropneumatic regulator 51 such that the air pressure of the pressurized air to be supplied to the first suction-side air chamber 26A reaches a value P13 which is lower than a value P11 at the last time (time t22 to time t24). The first electropneumatic regulator 51 adjusts the air pressure of the pressurized air to be supplied to the first suction-side air chamber 26A, to reach the value P13 on the basis of the pressure decrease command. Accordingly, the first bellows 13 starts expansion operation from the contracted state. The expansion speed thereof becomes lower than the expansion speed at the last expansion operation of the first bellows 13.

Next, the control unit 6 determines whether or not the proximity sensor 29B detects the expanded state of the first bellows 13 (is turned ON) before the proximity sensor 31A detects the mid-contraction state of the second bellows 14 (is turned ON). Here, the expansion speed of the first bellows 13 becomes lower as described above, lengthening the expansion time of the first bellows 13, whereby the first bellows 13 reaches the expanded state at time t28 at which the second bellows 14 reaches the mid-contraction state.

Therefore, since the proximity sensor 29B does not detect the expanded state of the first bellows 13 (is OFF) before the second bellows 14 reaches the mid-contraction state, the control unit 6 determines that the proximity sensor 29B has not been turned ON. Due to this determination result, at time t28 at which the second bellows 14 reaches the mid-contraction state, the pressure decrease determination by the control unit 6 is not performed, and thus the control unit 6 does not output the pressure decrease command at the next expansion of the first bellows 13.

[Abnormality Determination]

In FIG. 1, while the control unit 6 is performing drive control as described above, if an abnormality such as a failure occurs in the first electropneumatic regulator 51, the first electropneumatic regulator 51 maintains the air pressure adjusted immediately before the occurrence of the abnormality. Therefore, even if the control unit 6 outputs the pressure increase command in the pressure increase control or the pressure decrease command in the pressure decrease control to the first electropneumatic regulator 51, the air pressure of the pressurized air cannot be adjusted by the first electropneumatic regulator 51. Therefore, the control unit 6 consecutively outputs the pressure increase command or the pressure decrease command to the first electropneumatic regulator 51.

Similarly, if an abnormality such as a failure occurs in the second electropneumatic regulator 52, the air pressure of the pressurized air cannot be adjusted by the second electropneumatic regulator 52. Therefore, the control unit 6 consecutively outputs the pressure increase command or the pressure decrease command to the second electropneumatic regulator 52. The control unit 6 of the present embodiment performs an abnormality determination of determining whether or not the first electropneumatic regulator 51 and the second electropneumatic regulator 52 are abnormal, by using this point of continuous output.

Specifically, the control unit 6 counts the number of times the pressure increase control has been consecutively performed for the first electropneumatic regulator 51 (second electropneumatic regulator 52). The control unit 6 of the present embodiment counts the number of times the determination result of the pressure increase determination has consecutively become positive, as the number of times the pressure increase control has been consecutively performed. The control unit 6 determines whether or not the counted number of times has exceeded a predetermined number of times. When the determination result thereof is positive, the control unit 6 determines that the first electropneumatic regulator 51 (second electropneumatic regulator 52) is abnormal.

The control unit 6 also counts the number of times the pressure decrease control has been consecutively performed for the first electropneumatic regulator 51 (second electropneumatic regulator 52). The control unit 6 of the present embodiment counts the number of times the determination result of the pressure decrease determination has consecutively become positive, as the number of times the pressure decrease control has been consecutively performed. The control unit 6 determines whether or not the counted number of times has exceeded a predetermined number of times. When the determination result thereof is positive, the control unit 6 determines that the first electropneumatic regulator 51 (second electropneumatic regulator 52) is abnormal.

From the above, when either one of the number of times the determination result of the pressure increase determination has consecutively become positive and the number of times the determination result of the pressure decrease determination has consecutively become positive for the first electropneumatic regulator 51 (second electropneumatic regulator 52) has exceeded the predetermined number of times, the control unit 6 determines that the first electropneumatic regulator 51 (second electropneumatic regulator 52) is abnormal. When the control unit 6 determines that the first electropneumatic regulator 51 or the second electropneumatic regulator 52 is abnormal, the control unit 6 switches the first solenoid valve 4 and the second solenoid valve 5 to stop the drive of each of the first driving unit 27 and the second driving unit 28.

The predetermined number of times may be set to the same value or different values for the number of times the determination result of the pressure increase determination has consecutively become positive and the number of times the determination result of the pressure decrease determination has consecutively become positive.

Figure 7:
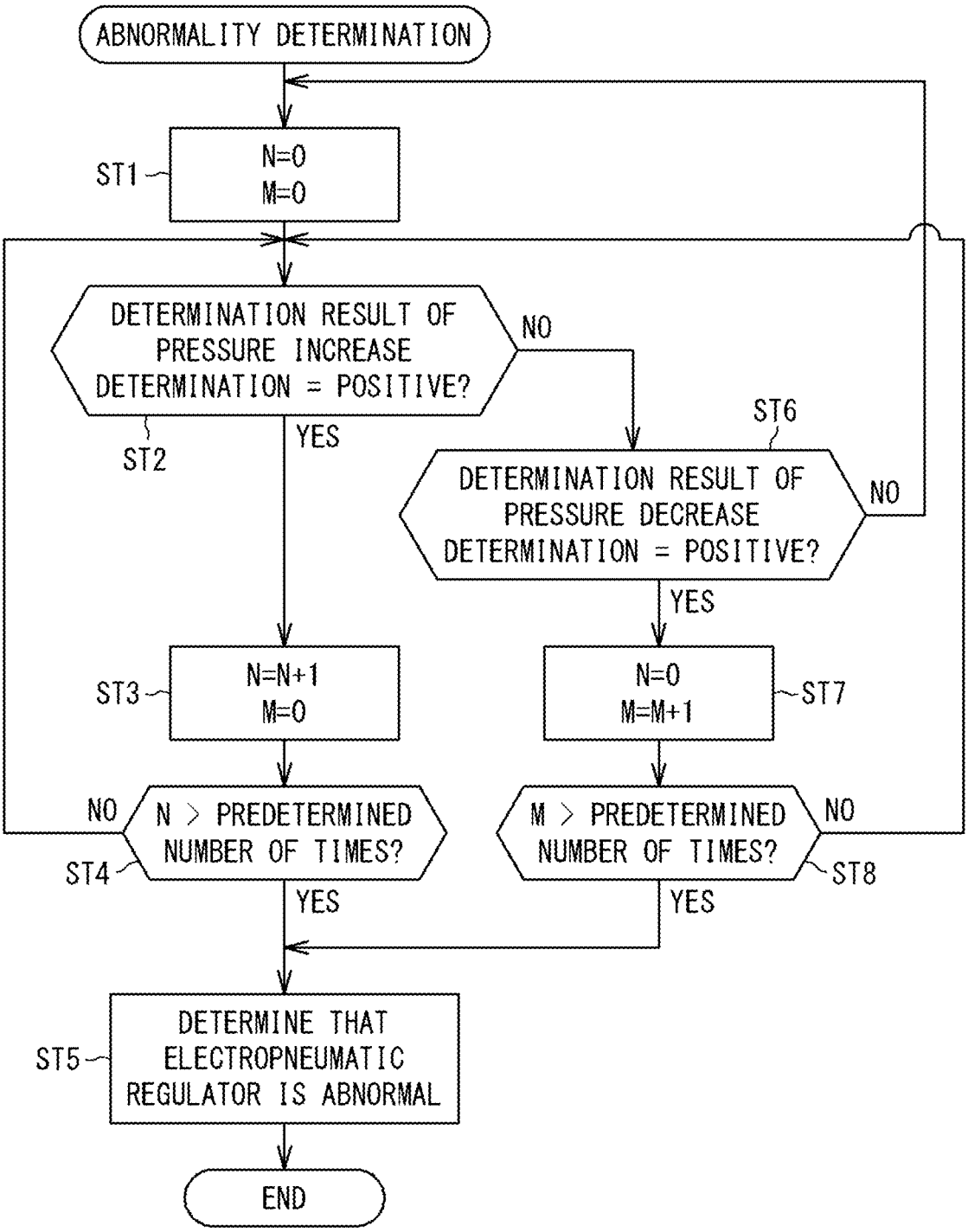
FIG. 7 is a flowchart showing an example of an abnormality determination.

FIG. 7 is a flowchart showing an example of the abnormality determination performed by the control unit 6 during drive control. Hereinafter, the abnormality determination performed by the control unit 6 will be described with reference to FIG. 7. The abnormality determination for the first electropneumatic regulator 51 and the abnormality determination for the second electropneumatic regulator 52 are performed in the same manner, and thus the abnormality determination for the first electropneumatic regulator 51 will be described here. First, the control unit 6 sets the respective values of a count number of times N and a count number of times M to 0 which is the initial value (step ST1). The count number of times N is the number of times the determination result of the pressure increase determination has consecutively become positive. The count number of times M is the number of times the determination result of the pressure decrease determination has consecutively become positive.

Next, when the control unit 6 performs the pressure increase determination for the first electropneumatic regulator 51 during drive control, if the determination result thereof is positive (in the case of "Yes" in step ST2), the control unit 6 adds 1 to the count number of times N and resets the count number of times M to 0 (step ST3).

Next, the control unit 6 determines whether or not the count number of times N has exceeded a predetermined number of times (step ST4). When the count number of times N has not exceeded the predetermined number of times (in the case of "No" in step ST4), the control unit 6 returns to step ST2. Thus, by repeatedly performing the process from step ST2 to step ST4, the count number of times N gradually increases. Then, when the count number of times N has exceeded the predetermined number of times (in the case of "Yes" in step ST4), the control unit 6 determines that the first electropneumatic regulator 51 is abnormal (step ST5), and ends the process.

On the other hand, when, in step ST2, the determination result of the pressure increase determination is negative (in the case of "No" in step ST2), the control unit 6 shifts to step ST6. When, in step ST6, the control unit 6 performs the pressure decrease determination for the first electropneumatic regulator 51, if the determination result thereof is positive (in the case of "Yes" in step ST6), the control unit 6 resets the count number of times N to 0 and adds 1 to the count number of times M (step ST7). In addition, when the determination result of the pressure decrease determination is negative (in the case of "No" in step ST6), the control unit 6 returns to step ST1 without performing the process in step ST7. In the present embodiment, the count number of times N is reset in step ST7, but the count number of times N may be reset at the time when it is determined as "No" in step ST2.

When the control unit 6 performs the process in step ST7, the control unit 6 next determines whether or not the count number of times M has exceeded a predetermined number of times (step ST8). When the count number of times M has not exceeded the predetermined number of times (in the case of "No" in step ST8), the control unit 6 returns to step ST2. Thus, by repeatedly performing the process in step ST2, step ST6, step ST7, and step ST8, the count number of times M gradually increases. Then, when the count number of times M has exceeded the predetermined number of times (in the case of "Yes" in step ST8), the control unit 6 determines that the first electropneumatic regulator 51 is abnormal (step ST5), and ends the process.

[Advantageous Effects of Present Embodiment]

In the bellows pump device 1 of the present embodiment, the control unit 6 counts the number of times the pressure increase control for the first electropneumatic regulator 51 (second electropneumatic regulator 52) has been consecutively performed, and when the counted number of times has exceeded the predetermined number of times, the control unit 6 determines that the first electropneumatic regulator 51 (second electropneumatic regulator 52) is abnormal. Accordingly, with an inexpensive configuration that does not use a pressure gauge or the like, it is possible to grasp that an abnormality has occurred in the first electropneumatic regulator 51 (second electropneumatic regulator 52).

The control unit 6 counts the number of times the pressure decrease control for the first electropneumatic regulator 51 (second electropneumatic regulator 52) has been consecutively performed, and when the counted number of times has exceeded the predetermined number of times, the control unit 6 determines that the first electropneumatic regulator 51 (second electropneumatic regulator 52) is abnormal. Accordingly, with an inexpensive configuration that does not use a pressure gauge or the like, it is possible to grasp that an abnormality has occurred in the first electropneumatic regulator 51 (second electropneumatic regulator 52).

When either one of the number of times the pressure increase control has been consecutively performed and the number of times the pressure decrease control has been consecutively performed has exceeded the predetermined number of times, the control unit 6 determines that the first electropneumatic regulator 51 (second electropneumatic regulator 52) is abnormal. Therefore, regardless of whether the pressure increase control is consecutively performed or the pressure decrease control is consecutively performed, it is possible to grasp that an abnormality has occurred in the first electropneumatic regulator 51 (second electropneumatic regulator 52).

The control unit 6 counts the number of times the determination result of the pressure increase determination has consecutively become positive, as the number of times the pressure increase control has been consecutively performed. Therefore, the control unit 6 can determine that the number of times the pressure increase control has been consecutively performed has exceeded the predetermined number of times, before outputting the pressure increase command to the first electropneumatic regulator 51 (second electropneumatic regulator 52). Accordingly, it is possible to quickly grasp that an abnormality has occurred in the first electropneumatic regulator 51 (second electropneumatic regulator 52).

The control unit 6 counts the number of times the determination result of the pressure decrease determination has consecutively become positive, as the number of times the pressure decrease control has been consecutively performed. Therefore, the control unit 6 can determine that the number of times the pressure decrease control has been consecutively performed has exceeded the predetermined number of times, before outputting the pressure decrease command to the first electropneumatic regulator 51 (second electropneumatic regulator 52). Accordingly, it is possible to quickly grasp that an abnormality has occurred in the first electropneumatic regulator 51 (second electropneumatic regulator 52).

[Others]

In the above embodiment, the first detection unit 29 is composed of the proximity sensors 29A and 29B, but may be composed of a displacement sensor using laser light or the like. Similarly, the second detection unit 31 is composed of the proximity sensors 31A and 31B, but may be composed of a displacement sensor using laser light or the like.

In the above embodiment, when the control unit 6 determines that the first electropneumatic regulator 51 or the second electropneumatic regulator 52 is abnormal, the control unit 6 stops the drive of each of the first driving unit 27 and the second driving unit 28, but in addition to or instead of this, the control unit 6 may output a warning sound or the like by a notification means.

In the above embodiment, as the number of times the pressure increase control has been consecutively performed, the control unit 6 uses the number of times the determination result of the pressure increase determination has consecutively become positive, but may use the number of times the pressure increase command has been consecutively outputted. Similarly, as the number of times the pressure decrease control has been consecutively performed, the control unit 6 uses the number of times the determination result of the pressure decrease determination has consecutively become positive, but may use the number of times the pressure decrease command has been consecutively outputted.

The embodiment disclosed herein is merely illustrative and not restrictive in all aspects. The scope of the present invention is defined by the scope of the claims rather than the meaning described above, and is intended to include meaning equivalent to the scope of the claims and all modifications within the scope.

REFERENCE SIGNS LIST

1 bellows pump device
6 control unit
13 first bellows (bellows)
14 second bellows (bellows)
21A first discharge-side air chamber (discharge-side fluid chamber)
21B second discharge-side air chamber (discharge-side fluid chamber)
26A first suction-side air chamber (suction-side fluid chamber)

26B second suction-side air chamber (suction-side fluid chamber)
27 first driving unit (driving unit)
28 second driving unit (driving unit)
29 first detection unit (detection unit)
31 second detection unit (detection unit)
51 first electropneumatic regulator (fluid pressure adjustment unit)
52 second electropneumatic regulator (fluid pressure adjustment unit)

The invention claimed is:

1. A bellows pump device comprising:

a pair of bellows expandable/contractible independently of each other and configured to suck a transport fluid thereinto by expansion thereof and to discharge the transport fluid therefrom by contraction thereof;

a pair of driving units each having a suction-side fluid chamber and a discharge-side fluid chamber and configured to cause the respective bellows to expand to a predetermined expanded state by supplying a pressurized fluid to the suction-side fluid chambers and to cause the respective bellows to contract to a predetermined contracted state by supplying the pressurized fluid to the discharge-side fluid chambers;

a pair of fluid pressure adjustment units configured to adjust fluid pressures of a pressurized fluid to be supplied to the suction-side fluid chambers of the respective driving units;

a pair of detection units configured to detect expanded/contracted states of the respective bellows; and a control unit configured to control the pair of driving units and the pair of fluid pressure adjustment units on the basis of respective detection signals of the pair of detection units, wherein the control unit performs drive control of controlling the pair of driving units such that, before one bellows out of the pair of bellows comes into the contracted state, the other bellows is caused to contract from the expanded state, the control unit performs pressure increase control of performing a pressure increase determination of determining whether or not the other bellows is in the middle of expansion when the one bellows contracts to a mid-contraction state before the contracted state, and when a determination result of the pressure increase determination is positive, outputting a pressure increase command to the fluid pressure adjustment unit corresponding to the driving unit for causing the other bellows to expand, such that the fluid pressure at next expansion of the other bellows is increased, and the control unit counts a number of times the pressure increase control has been consecutively performed, and when the counted number of times has exceeded a predetermined number of times, the control unit determines that the fluid pressure adjustment unit is abnormal.

2. The bellows pump device according to claim 1, wherein the control unit further performs pressure decrease control of performing a pressure decrease determination of determining whether or not the other bellows has continued to be in the expanded state for a predetermined time or longer when the one bellows contracts to the mid-contraction state before the contracted state, and when a determination result of the pressure decrease determination is positive, outputting a pressure decrease command to the fluid pressure adjustment unit corresponding to the driving unit for causing the other bellows to expand, such that the fluid pressure at next expansion of the other bellows is decreased, and the control unit counts a number of times the pressure decrease control has been consecutively performed, and when either one of the number of times the pressure increase control has been consecutively performed and the number of times the pressure decrease control has been consecutively performed has exceeded the predetermined number of times, the control unit determines that the fluid pressure adjustment unit is abnormal.

3. The bellows pump device according to claim 1, wherein the control unit counts a number of times the determination result of the pressure increase determination has consecutively become positive, as the number of times the pressure increase control has been consecutively performed.

4. A bellows pump device comprising:

a pair of bellows expandable/contractible independently of each other and configured to suck a transport fluid thereinto by expansion thereof and to discharge the transport fluid therefrom by contraction thereof;

a pair of driving units each having a suction-side fluid chamber and a discharge-side fluid chamber and configured to cause the respective bellows to expand to a predetermined expanded state by supplying a pressurized fluid to the suction-side fluid chambers and to cause the respective bellows to contract to a predetermined contracted state by supplying the pressurized fluid to the discharge-side fluid chambers;

a pair of fluid pressure adjustment units configured to adjust fluid pressures of a pressurized fluid to be supplied to the suction-side fluid chambers of the respective driving units;

a pair of detection units configured to detect expanded/contracted states of the respective bellows; and a control unit configured to control the pair of driving units and the pair of fluid pressure adjustment units on the basis of respective detection signals of the pair of detection units, wherein the control unit performs drive control of controlling the pair of driving units such that, before one bellows out of the pair of bellows comes into the contracted state, the other bellows is caused to contract from the expanded state, the control unit performs pressure decrease control of performing a pressure decrease determination of determining whether or not the other bellows has continued to be in the expanded state for a predetermined time or longer when the one bellows contracts to a mid-contraction state before the contracted state, and when a determination result of the pressure decrease determination is positive, outputting a pressure decrease command to the fluid pressure adjustment unit corresponding to the driving unit for causing the other bellows to expand, such that the fluid pressure at next expansion of the other bellows is decreased, and the control unit counts a number of times the pressure decrease control has been consecutively performed, and when the counted number of times has exceeded a predetermined number of times, the control unit determines that the fluid pressure adjustment unit is abnormal.

5. The bellows pump device according to claim 4, wherein the control unit counts a number of times the determination result of the pressure decrease determination has consecutively become positive, as the number of times the pressure decrease control has been consecutively performed.

* * * * *